US008472856B2

(12) United States Patent
Ninomiya et al.

(10) Patent No.: US 8,472,856 B2
(45) Date of Patent: Jun. 25, 2013

(54) IMAGE FORMING APPARATUS

(75) Inventors: Hiromichi Ninomiya, Kanagawa (JP); Hiroshi Mizusawa, Tokyo (JP); Naohiro Kumagai, Kanagawa (JP); Hiroki Matsuura, Kanagawa (JP); Yoshinori Ozawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 317 days.

(21) Appl. No.: 12/929,695

(22) Filed: Feb. 9, 2011

(65) Prior Publication Data

US 2011/0206432 A1 Aug. 25, 2011

(30) Foreign Application Priority Data

Feb. 23, 2010 (JP) ..... 2010-036778

(51) Int. Cl.
*G03G 21/00* (2006.01)

(52) U.S. Cl.
USPC ..... 399/346; 399/96; 399/116; 399/111

(58) Field of Classification Search
USPC ..... 399/349, 96, 116, 111
See application file for complete search history.

(56) References Cited

U.S. PATENT DOCUMENTS

| | | | | |
|---|---|---|---|---|
| 7,542,712 | B2 | 6/2009 | Tanaka et al. | |
| 7,831,189 | B2 * | 11/2010 | Harada et al. | 399/346 |
| 7,885,595 | B2 | 2/2011 | Ninomiya et al. | |
| 7,933,546 | B2 * | 4/2011 | Fukao et al. | 399/346 |
| 2005/0164108 | A1 | 7/2005 | Murakami et al. | |
| 2007/0183824 | A1 | 8/2007 | Suda et al. | |
| 2009/0060536 | A1 | 3/2009 | Kumagai | |
| 2009/0196665 | A1 | 8/2009 | Tanaka et al. | |
| 2009/0297238 | A1 | 12/2009 | Matsuura et al. | |
| 2010/0129126 | A1 | 5/2010 | Kosuge et al. | |
| 2010/0183349 | A1 | 7/2010 | Shintani et al. | |
| 2010/0189461 | A1 | 7/2010 | Shintani et al. | |

FOREIGN PATENT DOCUMENTS

| | | | |
|---|---|---|---|
| CN | 1938652 | | 3/2007 |
| CN | 101504517 | | 8/2009 |
| JP | 11174810 | A | 7/1999 |
| JP | 2001356547 | A | 12/2001 |
| JP | 2006091459 | A | 4/2006 |
| JP | 2006251751 | A | 9/2006 |
| JP | 2008-139420 | | 6/2008 |

OTHER PUBLICATIONS

Chinese Office Action dated Aug. 30, 2012.

* cited by examiner

*Primary Examiner* — Walter L Lindsay, Jr.
*Assistant Examiner* — Roy Y Yi
(74) *Attorney, Agent, or Firm* — Harness, Dickey & Pierce, P.L.C.

(57) ABSTRACT

An image forming apparatus includes a plurality of image forming units that are arranged in parallel so as to be opposed to an intermediate transfer belt or a transfer carriage belt. A black image forming unit that forms a black toner image is arranged at a downstream end or upstream end in the running direction of the intermediate transfer belt or the transfer carriage belt with respect to the other image forming units. The black image forming unit is configured so that its lubricant supplying unit contains a larger amount of lubricant.

9 Claims, 2 Drawing Sheets

IMAGE FORMING APPARATUS

CROSS-REFERENCE TO RELATED APPLICATIONS

The present application claims priority to and incorporates by reference the entire contents of Japanese Patent Application No. 2010-036778 filed in Japan on Feb. 23, 2010.

BACKGROUND OF THE INVENTION

1. Field of the Invention

The present invention relates to an image forming apparatus using electrophotography, such as a copying machine, printer, facsimile, and MFPs thereof. In particular, the invention relates to a color image forming apparatus of tandem type in which a plurality of image forming units are arranged in parallel so as to be opposed to an intermediate transfer belt or a transfer carriage belt.

2. Description of the Related Art

As image forming apparatuses such as copying machines and printers, color image forming apparatuses of tandem type, having an intermediate transfer belt, have heretofore been known (for example, see Japanese Patent Application Laid-open No. 2006-91459 and Japanese Patent Application Laid-open No. 2001-356547).

Four photosensitive elements (image carriers) are arranged in parallel in positions opposed to the intermediate transfer belt. Black, yellow, magenta, and cyan toner images are formed on the four photosensitive elements, respectively. The toner images formed on the photosensitive elements in the respective colors are transferred to the intermediate transfer belt in a superposed manner at the positions opposed to the intermediate transfer belt. The toner images in the plurality of colors, carried by the intermediate transfer belt, are then transferred to a recording medium as a color image.

In such an image forming apparatus, in order to clean untransferred toner and other adhering substances off the photosensitive elements (image carriers) by a cleaning device without fail, as well as to reduce wear of the photosensitive elements, cleaning blades, and the like, there has been known a technique of using lubricant supplying units which supply the photosensitive elements with a lubricant (for example, see Japanese Patent Application Laid-open No. H11-174810).

More specifically, untransferred toner remaining on the photosensitive elements after the transfer step should be all removed by cleaning blades (cleaning devices) which are in contact with the photosensitive elements. With an aging degradation (wear) of the cleaning blades due to the contact with the photosensitive elements, it has sometimes been the case that untransferred toner slips through a gap between the worn-out cleaning blades and the photosensitive elements to cause a cleaning failure.

Even if the cleaning blades are not degraded, small particle size toners and spherical toners can get into slight gaps between the cleaning blades and the photosensitive elements. The toners could eventually get through the gaps, causing a cleaning failure.

Moreover, if toner, external additives contained in the toner, or adhering substances such as paper dust get through the gaps between the cleaning blades and the photosensitive elements, those substances could firmly stick to the photosensitive elements in a film-like form to cause filming.

To address such problems, a lubricant may be applied onto the photosensitive elements. The application of the lubricant lowers the coefficient of friction on the photosensitive elements, thereby reducing degradation of the cleaning blades and the photosensitive elements. This also improves the detachability of the adhering substances adhering to the photosensitive elements, such as untransferred toner, whereby the occurrence of a cleaning failure and filming over time can be suppressed.

Specifically, Japanese Patent Application Laid-open No. H11-174810 describes a lubricant supplying unit (lubricant applying device) which includes: a brush roller that makes sliding contact with the photosensitive element (image carrier); a solid lubricant that is in contact with the brush roller; and a spring that biases the solid lubricant toward the brush roller. The brush roller rotating in a predetermined direction gradually scrapes some of the solid lubricant, and the scraped lubricant is applied (supplied) to the surface of the image carrier by the brush roller.

Japanese Patent Application Laid-open No. 2006-91459, etc. disclose a technology, in which, in a color image forming apparatus of tandem type, the outer diameter of a photosensitive element in a black image forming unit is set to be larger than that of the photosensitive elements in other image forming units so that the black image forming unit, whose use frequency is higher than those of the other color image forming units, has an extended life.

The technology of the foregoing Japanese Patent Application Laid-open No. 2006-91459 extends the life of the black image forming unit whose use frequency is higher than those of the other color image forming units by increasing the outer diameter of the photosensitive element in the black image forming unit. There has thus been a problem because the image forming apparatus becomes accordingly larger in size.

Such a problem is not limited to image forming apparatuses of tandem type that use an intermediate transfer belt, but also applies to image forming apparatuses that use a transfer carriage belt (apparatuses in which a plurality of photosensitive elements are arranged in parallel so as to be opposed to a transfer carriage belt, and toner images on the photosensitive elements are transferred to a recording medium conveyed by the transfer carriage belt in a superposed manner).

SUMMARY OF THE INVENTION

It is an object of the present invention to at least partially solve the problems in the conventional technology.

According to an aspect of the present invention, there is provided an image forming apparatus including a plurality of image forming units that are arranged in parallel so as to be opposed to an intermediate transfer belt or a transfer carriage belt. The plurality of image forming units each includes: an image carrier that is opposed to the intermediate transfer belt or the transfer carriage belt and on a surface of which a toner image is to be formed; and a lubricant supplying unit that supplies a lubricant onto the image carrier. A black image forming unit that forms a black toner image among the plurality of image forming units is arranged at a downstream end or upstream end in a running direction of the intermediate transfer belt or the transfer carriage belt, and is configured so that the lubricant supplying unit contains a larger amount of lubricant with respect to other image forming units among the plurality of image forming units.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

Figure 1:
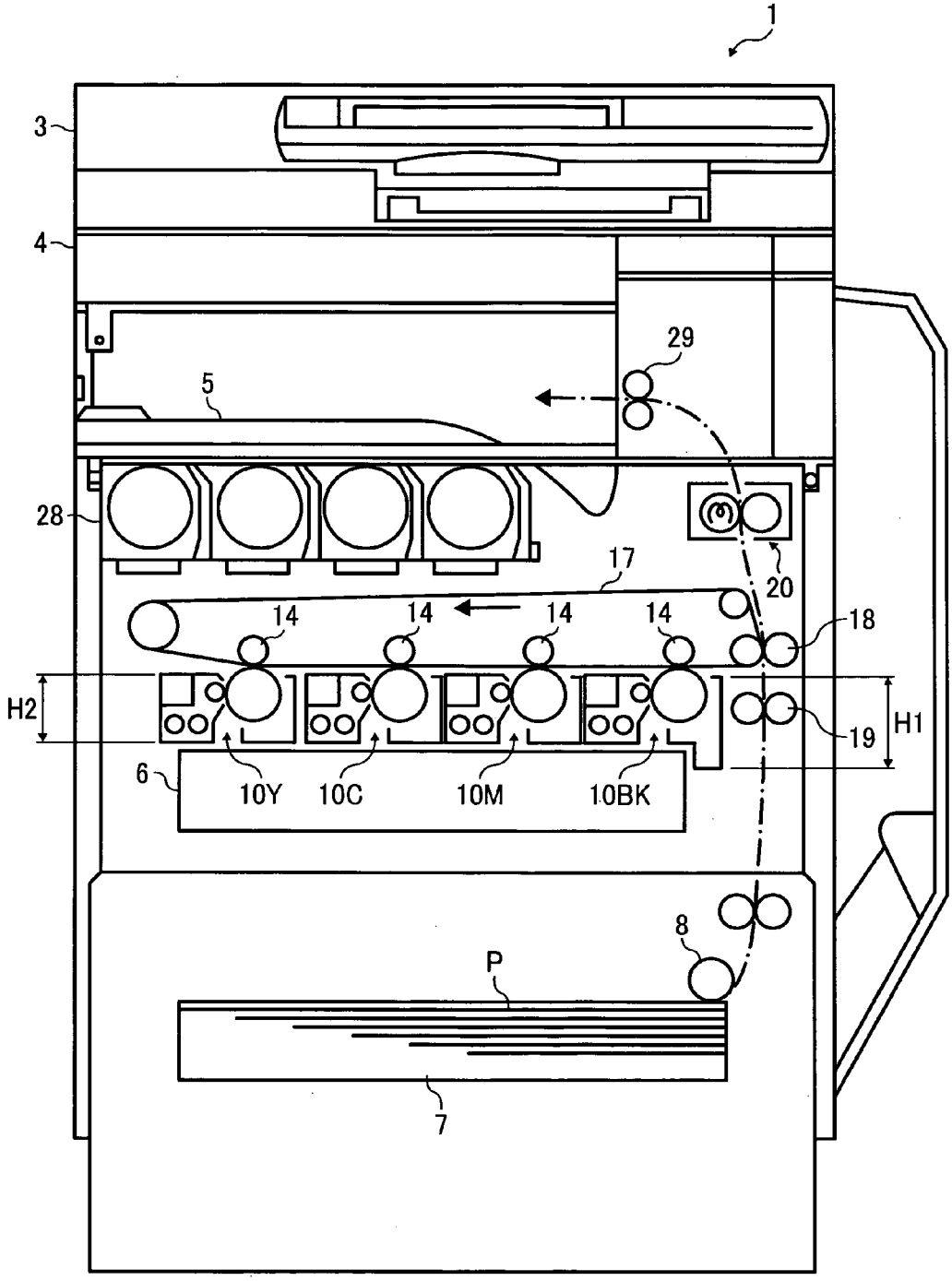
FIG. 1 is a diagram showing the overall configuration of an image forming apparatus according to an embodiment of the invention.

As employed herein, a "process cartridge" shall be defined as a unit that is detachably mounted on the body of the image forming apparatus, and in which an image carrier is integrated with at least one of the following: a charging unit that charges the image carrier; a developing unit (a developing device) that develops a latent image formed on the image carrier; and a cleaning unit that cleans the surface of the image carrier.

Embodiment

Hereinafter, a best mode for carrying out the invention will be described in detail with reference to the drawings. In the diagrams, identical or equivalent parts will be designated by like reference numerals. Redundant descriptions will be simplified or omitted as appropriate.

Initially, the overall configuration and operation of the image forming apparatus will be described with reference to FIG. 1.

An image forming apparatus 1 according to the present embodiment is a color image forming apparatus of tandem type in which a plurality of image forming units or process cartridges 10Y, 10M, 10C, and 10BK are arranged in parallel so as to be opposed to an intermediate transfer belt 17.

In FIG. 1, the reference numeral 1 designates an apparatus body of the color copying machine, the image forming apparatus. The reference numeral 3 designates a document feeding unit which feeds an original to a document reading unit 4. The reference numeral 4 designates the document reading unit which reads image information on the original. The reference numeral 6 designates a writing unit (exposing unit) which emits laser beams based on the input image information. The reference numeral 7 designates a paper feeding unit which contains recording media P such as a transfer sheet. The reference symbols 10Y, 10M, 10C, and 10BK designate the image forming units or process cartridges for respective colors (yellow, magenta, cyan, and black). The reference numeral 17 designates an intermediate transfer belt for toner images in a plurality of colors to be transferred to in a superposed manner. The reference numeral 18 designates a secondary transfer roller which transfers the toner images formed on the intermediate transfer belt 17 to a recording medium P. The reference numeral 20 designates a fixing unit which fixes the unfixed image on the recording medium P. The reference numeral 28 designates toner containers for supplying toners of respective colors to the developing units of the process cartridges (image forming units) 10Y, 10M, 10C, and 10BK.

Figure 2:
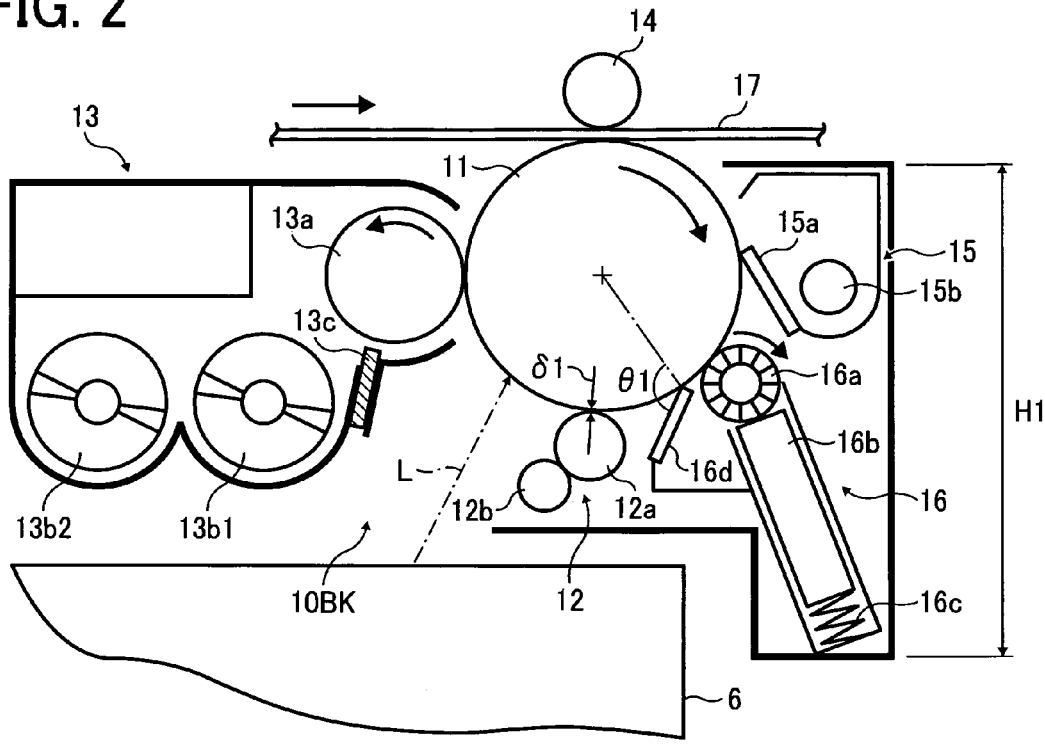
FIG. 2 is a diagram showing the configuration of a black image forming unit.
Figure 3:
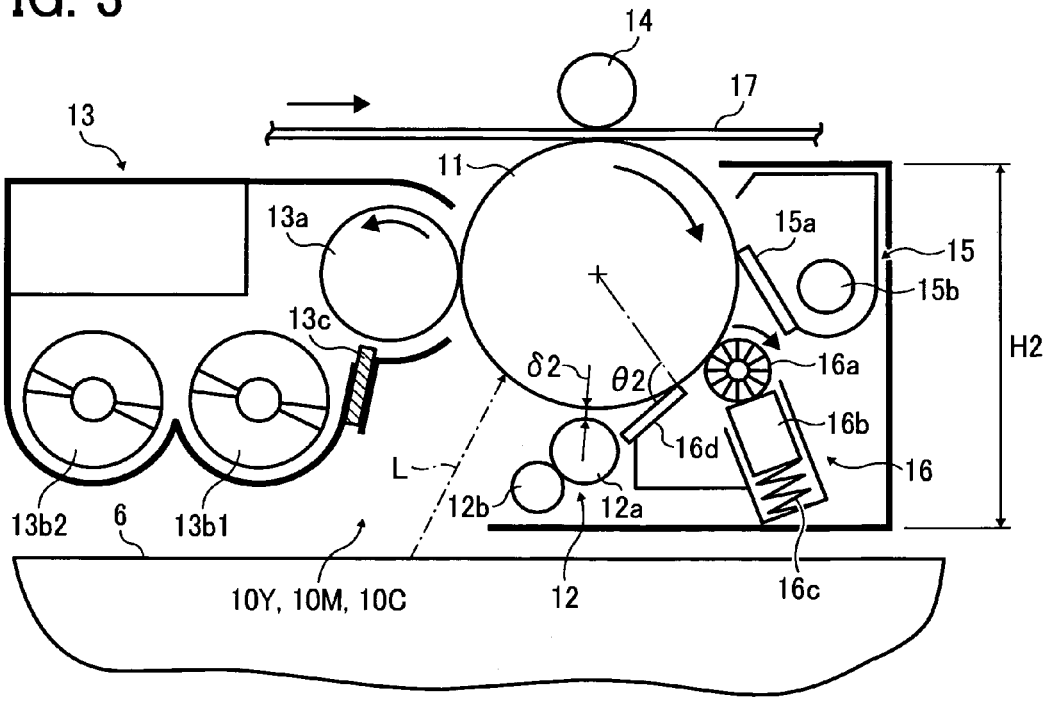
FIG. 3 is a diagram showing the configuration of a color image forming unit.

Here, the process cartridges 10Y, 10M, 10C, and 10BK (image forming units) each include an image carrier or photosensitive element 11, a charging unit 12, a developing unit (a developing device) 13, a cleaning unit (a cleaning device) 15, and a lubricant supplying unit (a lubricant supplying device) 16 which are integrated into one cartridge (see FIGS. 2 and 3). Reaching the end of their life, the process cartridges 10Y, 10M, 10C, and 10BK are each replaced and reloaded into the apparatus body 1.

Toner images of respective colors (yellow, magenta, cyan, and black) are formed on the photosensitive elements 11 (image carriers) of the process cartridges 10Y, 10M, 10C, and 10BK.

Now, the ordinary operation of the image forming apparatus when forming a color image will be described.

Initially, an original is fed from an original table by carriage rollers of the document feeding unit 3, and placed on an exposure glass of the document reading unit 4. The document reading unit 4 optically reads the image information on the original that is placed on the exposure glass.

More specifically, the document reading unit 4 irradiates and scans the original image on the exposure glass with light that is emitted from a lighting lamp. The light reflected from the original is passed through a group of mirrors and lenses to form an image on color sensors. Color image information on the original is read by the color sensors in terms of respective color separation beams of RGB (read, green, and blue), and converted into electric image signals. Based on the RGB color separation image signals, an image processing unit (not shown) performs processing such as color conversion processing, color correction processing, and spatial frequency correction processing, thereby obtaining color image information on yellow, magenta, cyan, and black.

The image information on each color, yellow, magenta, cyan, and black, is transmitted to the writing unit 6. The writing unit 6 irradiates the photosensitive elements 11 of the process cartridges 10Y, 10M, 10C, and 10BK with respective corresponding laser beams (exposing beams) based on the image information on each color.

In the meantime, the four photosensitive elements 11 are each rotated clockwise in the diagram. The surfaces of the photosensitive elements 11 are uniformly charged at positions opposed to roller charging devices 12*a* (charging units 12) (charging step). Charge potentials are thereby formed on the photosensitive elements 11. The charged surfaces of the photosensitive elements 11 then reach their respective positions of laser beam irradiation.

In the writing unit 6, laser beams corresponding to the image signals are emitted from light sources so as to correspond to the respective colors. Although not shown in the diagram, the laser beams are incident on and reflected by a polygon mirror before transmitted through a plurality of lenses. The laser beams transmitted through the plurality of lenses pass through respective different optical paths for yellow, magenta, cyan, and black color components (exposure step).

The surface of the photosensitive element 11 of the first process cartridge 10Y from the left in the diagram is irradiated with the laser beam corresponding to the yellow component. Here, the laser beam for the yellow component is moved to scan the photosensitive element 11 in the direction of the rotating axis of the photosensitive element 11 (main-scanning direction) by the polygon mirror (not shown) which is rotating at high speed. An electrostatic latent image corresponding to the yellow component is thus formed on the photosensitive element 11 that is previously charged by the roller charging device 12*a*.

Similarly, the surface of the photosensitive element 11 of the second process cartridge 10C from the left in the diagram is irradiated with the laser beam corresponding to the cyan component. This forms an electrostatic latent image of the cyan component. The surface of the photosensitive element 11 of the third process cartridge 10M from the left in the diagram is irradiated with the laser beam corresponding to the magenta component. This forms an electrostatic latent image of the magenta component. The surface of the photosensitive element 11 of the fourth process cartridge 10BK (black image forming unit) from the left in the diagram (at the downstream end in the running direction of the intermediate transfer belt 17) is irradiated with the laser beam corresponding to the black component. This forms an electrostatic latent image of the black component.

Subsequently, the surfaces of the photosensitive elements 11 on which the electrostatic latent images of the respective colors are formed reach positions opposed to the respective developing units 13. The toners of the respective colors are supplied from the developing units 13 onto the photosensitive elements 11, whereby the latent images on the photosensitive element 11 are developed (developing step).

After the developing step, the surfaces of the photosensitive elements 11 reach respective positions opposed to the intermediate transfer belt 17. Here, primary transfer rollers 14 are arranged in the respective opposed positions so as to be in contact with the inner side of the intermediate transfer belt 17. At the positions of the primary transfer rollers 14, the toner images of the respective colors formed on the photosensitive elements 11 are transferred to the intermediate transfer belt 17 in a superposed manner in succession (first transfer step).

After the first transfer step, the surfaces of the photosensitive elements 11 reach positions opposed to the respective cleaning units 15. The cleaning units 15 reclaim untransferred toner remaining on the photosensitive elements 11 (cleaning step).

Subsequently, the surfaces of the photosensitive elements 11 pass the positions of the lubricant supplying units 16 and the positions of neutralizing units (not shown) in succession, whereby a series of image forming processes on the photosensitive elements 11 ends.

Now, the surface of the intermediate transfer belt 17 on which the images of the respective colors on the photosensitive elements 11 are transferred in a superposed manner runs in the direction of the arrow in the diagram and reaches the position of the secondary transfer roller 18. At the position of the secondary transfer roller 18, the full color image on the intermediate transfer belt 17 is secondarily transferred onto the recording medium P (secondary transfer step).

The surface of the intermediate transfer belt 17 then reaches the position of an intermediate transfer belt cleaning unit (not shown). The intermediate transfer belt cleaning unit collects untransferred toner from the intermediate transfer belt 17, whereby a series of transfer processes on the intermediate transfer belt 17 is completed.

The recording medium P is fed to the position of the secondary transfer roller 18 from the paper feeding unit 7 through a feed guide, registration rollers 19, and the like.

More specifically, a recording medium P is fed by a paper feeding roller 8 from the paper feeding unit 7 in which recording media P are stored. The recording medium P is passed through feed guide before led to the registration rollers 19. Reaching the registration rollers 19, the recording medium P is fed to the position of the secondary transfer roller 18 in synchronization with the toner image on the intermediate transfer belt 17.

The recording medium P with the transferred full color image is then introduced into the fixing unit 20. In the fixing unit 20, the color image is fixed onto the recording medium P in a nip between a fixing roller and a pressing roller.

After the fixing step, the recording medium P is discharged as an output image from the apparatus body 1 by discharging rollers 29. The discharged recording medium P is stacked on a discharging unit 5, whereby a series of image forming processes is completed.

Although not shown in the diagram, the image forming apparatus 1 according to the present embodiment has a contacting and separating mechanism. The contacting and separating mechanism can freely move the primary transfer rollers 14 that are intended to make contact with the photosensitive elements 11 of the color process cartridges 10Y, 10M, and 10C (the three color photosensitive elements 11 excluding the photosensitive element 11 of the monochrome process cartridge 10BK), into and out of contact with those photosensitive elements 11 along with the intermediate transfer belt 17.

When forming a monochrome image, the contacting and separating mechanism is operated to separate the three primary transfer rollers 14 from the three color photosensitive elements 11, so that the intermediate transfer belt 17 makes contact only with the photosensitive element 11 of the monochrome process cartridge 10BK. Consequently, aside from the fact that black often occupies a large proportion of a color image, the monochrome process cartridge 10BK (black image forming unit) is in full operation when forming monochrome images. The use frequency (operating ratio) of the monochrome process cartridge 10BK is thus typically higher than those of the color process cartridges 10Y, 10M and 10C.

Next, the image forming units of the image forming apparatus will be described in detail with reference to FIGS. 2 and 3.

FIG. 2 is a diagram showing the configuration of the process cartridge 10BK (monochrome process cartridge), the black image forming unit. FIG. 3 is a diagram showing the configuration of the process cartridges 10Y, 10M, and 10C (color process cartridges), the other image forming units. The monochrome process cartridge 10BK and the color process cartridges 10Y, 10M, and 10C are composed of generally the same components except that toners of different colors are used for the image forming processes, and that solid lubricants 16*b* have different sizes.

As shown in FIGS. 2 and 3, the process cartridges 10Y, 10M, 10C, and 10BK each include the following components: a photosensitive element 11 as an image carrier; a charging unit 12 which charges the photosensitive element 11; a developing unit 13 which develops an electrostatic latent image formed on the photosensitive element 11; a cleaning unit 15 which reclaims untransferred toner from the photosensitive element 11; and a lubricant supplying unit 16 which supplies a lubricant onto the photosensitive element 11. Such elements are integrally accommodated in a case.

The photosensitive element 11, the image carrier, is an organic photosensitive element of negative chargeability. The photosensitive element 11 is formed by forming photosensitive and other layers on a drum-shaped conductive supporting member.

Although not shown in the diagrams, the photosensitive element 11 includes an underlying layer as an insulating layer, a charge generating layer and a charge transport layer as a photosensitive layer, and a protective layer (surface layer). Such layers are stacked in order on a conductive supporting member as a base layer.

The conductive supporting member (base layer) of the photosensitive element 11 may be made of a conductive material having a volume resistance of $10^{10}$ Ωcm or less.

The photosensitive element 11 may have a photosensitive layer of layered structure or single layer structure.

A description will initially be given of the case where the photosensitive layer has a layered structure including a charge generating layer and a charge transport layer.

The charge generating layer includes a charge generating material as a main component. Publicly known charge generating materials may be used for the charge generating layer. Specific examples of the charge generating materials available include monoazo pigments, disazo pigments, trisazo pigments, perylene series pigments, perinone series pigments, quinacridone series pigments, quinone series fused polycyclic compounds, squaric acid series dyes, other phthalocyanine series pigments, naphthalocyanine series pigments, and azulenium dyes. Any one of such charge generating materials may be used alone. Two or more may be mixed for use.

The charge generating layer is formed by dispersing the charge generating material(s) in an appropriate solvent by using a ball mill, attritor, sand mill, ultrasound, or the like with a binding resin if needed, and applying the resulting solution onto the conductive supporting member (or underlying layer), followed by drying. The solution may be applied by using a method such as dip coating, spray coating, bead coating, nozzle coating, spinner coating, and ring coating. An appropriate thickness of the charge generating layer is around 0.01 to 5 μm (preferably around 0.1 to 2 μm).

The charge transport layer can be formed by dissolving or dispersing a charge transport material and a binding resin in an appropriate solvent, and applying the resulting solution onto the charge generating layer, followed by drying. One or a plurality of types of plasticizing agents, leveling agents, antioxidants, and the like may be added if needed. The appropriate amount of the charge transport material is 20 to 300 parts by weight (preferably 40 to 150 parts by weight) with respect to 100 parts by weight of binding resin. In view of resolution and responsivity, it is preferred that the charge transport layer have a thickness of 25 μm or less. The lower limit is preferably 5 μm or higher, though depending on the image forming processes (the charge potential and the like in particular).

Next, a description will be given of the case where the photosensitive layer has a single layer structure.

The photosensitive layer of single layer structure can be formed by dissolving or dispersing the foregoing charge generating material(s), charge transport material, binding resin, and the like in an appropriate solvent, and applying the resulting solution onto the conductive supporting member (or underlying layer), followed by drying. The photosensitive layer may be made of the charge generating material(s) and binding resin without a charge transport material. Plasticizing agents, leveling agents, antioxidants, and the like may be added if needed.

The binding resin may be the one that is used for forming the charge transport layer. The binding resin used for forming the charge generating layer may be mixed for use. Polymer charge transport materials may also be used favorably. With respect to 100 parts by weight of the binding resin, the preferred amount of the charge generating material(s) is 5 to 40 parts by weight. The preferred amount of the charge transport material is 0 to 190 parts by weight (even preferably 50 to 150 parts by weight).

The photosensitive layer of single layer structure can be formed by applying a coating solution by dip coating, spray coating, bead coating, ring coating, or the like. The coating solution can be prepared by dispersing the charge generating material(s), binding resin, and charge transport material in a disperser or the like using a solvent such as tetrahydrofuran, dioxane, dichloroethane, and cyclohexane. The appropriate thickness of the photosensitive layer is around 5 to 25 μm.

The underlying layer of the photosensitive element 11 typically contains a resin as its primary component. In view of the application of the photosensitive layer with a solvent onto the resin, it is desired that the resin have high solvent resistance to typical organic solvents. Examples of such a resin include: water soluble resins such as polyvinyl alcohol, casein, and sodium polyacrylate; alcohol soluble resins such as copolyamide and methoxymethylated polyamide; and curable resins that form a three-dimensional network structure, such as polyurethane, melamine resin, phenolic resin, alkyd-melamine resin, and epoxy resin. The underlying layer may additionally contain fine powder pigments made of metal oxides such as titanium oxide, silica, alumina, zirconium oxide, tin oxide, and indium oxide for the purposes of moire prevention, reduction of residual potential, and the like. Like the foregoing photosensitive layer, such underlying layers can be formed by using an appropriate solvent and an appropriate method of coating. The appropriate thickness of the underlying layer is around 0 to 5 μm.

The protective layer of the photosensitive element 11 is intended to reduce the mechanical wear on the surface of the photosensitive element 11.

In the present embodiment, the protective layer is made of a binder resin having a cross-linked structure. The cross-linked structure refers to a three-dimensional network structure that is formed of a reactive monomer having a plurality of crosslinkable functional groups in a single molecular, by causing a cross-linking reaction by means of light or thermal energy. The binder resin with such a network structure has high wear resistance. In view of electric stability, printing durability, and life, the foregoing reactive monomer may be made of a monomer having a charge transport property in part or in whole. Such a monomer can form charge transport sites in the network structure and provide a sufficient protective layer function as well.

Examples of the reactive monomer having a charge transport property include the following: compounds that contain at least one charge transporting component and at least one silicon atom having a hydrolysable substituent in a single molecule; compounds that contain a charge transporting component and a hydroxyl group in a single molecule; compounds that contain a charge transporting component and a carboxyl group in a single molecule; compounds that contain a charge transporting component and an epoxy group in a single molecule; and compounds that contain a charge transporting component and an isocyanate group in a single molecule. Each of such charge transporting materials containing a reactive group may be used alone. Two or more may be used in combination.

A reactive monomer having a triarylamine structure may be used as the monomer having a charge transporting property because of its high electric and chemical stability, high carrier mobility, etc.

Monofunctional and bifunctional polymerizable monomers and polymerizable oligomers may also be used for the sake of providing additional functions, such as adjusting the coating viscosity, easing the stress of the cross-linked charge transport layer, reducing the surface energy, and reducing the coefficient of friction. Such polymerizable monomers and oligomers may be publicly known ones.

The protective layer is formed by polymerizing or cross-linking a hole transporting compound by means of heat or light. Some thermal polymerization reactions can proceed only with thermal energy, and some need a polymerization initiator. The addition of an initiator is preferred in order to promote efficient reaction at lower temperatures. For photo-polymerization, it is preferred to use ultraviolet rays for the light. A photo-polymerization initiator is typically added since the reaction rarely proceeds with light energy alone.

Such a polymerization initiator primarily absorbs ultraviolet rays having wavelengths of 400 nm or less to generate active species such as radicals and ions, thereby starting polymerization. The above-described thermal and photo-polymerization initiators may be used in combination.

The protective layer with such a network structure has a high wear resistance but causes a high volumetric shrinkage during the cross-linking reaction. Too large a thickness can thus cause cracking, and the like. In such a case, the protective layer may have a layered structure so that a protective layer made of low-molecular dispersion polymer is formed at the bottom (on the photosensitive layer side) and a protective layer having a cross-linked structure is formed at the top (on the surface side).

As described above, according to the present embodiment, a hard protective layer made of a binder resin that has a cross-linked structure and contains a charge transport material is formed on the surface of the photosensitive element 11. The provision of such a protective layer makes it possible to prevent the films of the photosensitive element 11 from being scraped off by a cleaning blade 15*a*, without impairing the function of the photosensitive element 11.

The charging unit 12 includes the roller charging device 12*a* and a cleaning roller 12*b*. The roller charging device 12*a* is a roller member that is formed by covering a conductive core with an elastic layer having a medium resistance. The roller charging device 12*a* is arranged downstream of the lubricant supplying unit 16 in the direction of rotation of the photosensitive element 11. The roller charging device 12*a* is opposed to and kept out of contact with the photosensitive element 11 so as to avoid adhesion of the lubricant that is supplied onto the photosensitive element 11 by the lubricant supplying unit 16. The cleaning roller 12*b* is intended to remove stains from the roller charging device 12*a*, and is arranged in contact with the roller charging device 12*a*.

In the charging unit 12 of such a configuration, a predetermined voltage is applied to the roller charging device 12*a* from a not-shown power source unit, whereby the surface of the opposed photosensitive element 11 is charged uniformly.

The developing unit (the developing device) 13 mainly includes the following: a developing roller 13*a* which is opposed to the photosensitive element 11; a first conveying screw 13*b*1 which is opposed to the developing roller 13*a*; a second conveying screw 13*b*2 which is opposed to the first conveying screw 13*b*1 with a partition member therebetween; and a doctor blade 13*c* which is opposed to the developing roller 13*a*. The developing roller 13*a* is composed of a magnet that is fixed inside and forms magnetic poles on the periphery of the roller, and a sleeve that rotates around the magnet. The magnet forms a plurality of magnetic poles on the developing roller 13*a* (sleeve), whereby a developer is carried on the developing roller 13*a*.

The developing unit 13 contains a two-component developer which is made of a carrier and toner.

A spherical toner having a circularity of 0.98 or higher is used for the sake of improved image quality. The "circularity" refers to an average circularity measured by a flow type particle image analyzer "FPIA-2000" (from Toa Medical Electronics Co., Ltd.). Specifically, 100 to 150 ml of water, from which solid impurities are removed in advance, is prepared in a container. As a dispersant, 0.1 to 0.5 ml of surface active agent (preferably, alkyl benzene sulfonate) is added. Approximately 0.1 to 0.5 g of measuring sample (toner) is added further. The suspension of the toner is then subjected to dispersion processing by an ultrasonic disperser for about one to three minutes. The resulting liquid dispersion having a concentration of 3000 to 10000 particles/μl is loaded into the foregoing analyzer and measured for toner shape and distribution.

Examples of the spherical toners available include ones that are mode spherical by subjecting irregular odd-shaped toners formed by grinding (grinded toners), which have heretofore been widely used, to heat treatment or the like, and ones that are manufactured by polymerization.

Conventionally, such spherical toners could get into the slight gap between the cleaning blade 15*a* and the photosensitive element 11 and eventually get through the gap to cause a cleaning failure. In the present embodiment, the lubricant supplying unit 16 applies the lubricant to the surface of the photosensitive element 11. This improves the detachability (removability) of the toner off the photosensitive element 11, and thereby prevents the occurrence of cleaning failures.

The cleaning unit 15 is arranged upstream of the lubricant supplying unit 16 in the direction of rotation of the photosensitive element 11. The cleaning unit 15 includes a cleaning blade 15*a* and a conveying coil 15*b*. The cleaning blade 15*a* is in contact with the photosensitive element 11. The conveying coil 15*b* conveys toner reclaimed in the cleaning unit 15 to a waste toner reclaim bin (not shown) as waste toner. The cleaning blade 15*a* is made of a rubber material such as urethane rubber, and put into contact with the surface of the photosensitive element 11 at a predetermined angle with a predetermined pressure. Consequently, adhering substances such as untransferred toner adhering to the photosensitive element 11 are mechanically scraped off and reclaimed into the cleaning unit 15. Aside from the untransferred toner, examples of the substances adhering to the photosensitive element 11 include paper dust from the recording medium P (sheet), discharge products generated on the photosensitive element 11 during the discharge of the roller charging device 12*a*, and toner additives.

The lubricant supplying unit 16 includes a brush-like rotating member 16*a*, a solid lubricant 16*b*, a compression spring 16*c*, and a blade-like member 16*d*. The brush-like rotating member 16*a* is covered with bristles which make sliding contact with the photosensitive element 11 and the solid lubricant 16*b*. The compression spring 16*c* biases the solid lubricant 16*b* toward the brush-like rotating member 16*a*. The blade-like member 16*d* makes the lubricant that is supplied onto the photosensitive element 11 by the brush-like rotating member 16*a* into a thin film. The blade-like member 16*d* is arranged downstream of the brush-like rotating member 16*a* in the direction of rotation of the photosensitive element 11, and is configured so as to make contact with the photosensitive element 11 in a counter direction.

The lubricant supplying unit 16 of such a configuration supplies the photosensitive element 11 with a thin film of lubricant. The configuration and operation of the lubricant supplying unit 16 will be detailed later.

Referring to FIG. 2, the foregoing image forming processes will be described in more detail.

The developing roller 13*a* rotates in the direction of the arrow in FIGS. 2 and 3 (counterclockwise). By the rotations of the first conveying screw 13*b*1 and the second conveying screw 13*b*2 which are arranged with the partition member therebetween, the developer in the developing unit 13 is agitated and mixed together with the toner which is supplied from the toner container 28 by a not-shown toner supplying unit. In the meantime, the developer and toner are circulated in the longitudinal directions (directions perpendicular to the planes of FIGS. 2 and 3).

The toner is charged by friction, attracted to the carrier, and carried on the developing roller 13*a* with the carrier. Carried on the developing roller 13*a*, the developer reaches the position of the doctor blade 13*c*. The developer on the developing roller 13*a* is adjusted to an appropriate amount in the position of the doctor blade 13*c* before reaching the position opposed to the photosensitive element 11 (developing area).

In the developing area, the toner included in the developer adheres to the electrostatic latent image formed on the surface of the photosensitive element 11. More specifically, the toner adheres to the latent image (to form a toner image) because of an electric field that is formed by a difference in potential (developing potential) between the latent image potential (exposing potential) of the image part where irradiated with the laser light L and the developing bias applied to the developing roller 13*a*.

Subsequently, almost all of the toner adhering to the photosensitive element 11 in the developing step is transferred to the intermediate transfer belt 17. Untransferred toner remaining on the photosensitive element 11 is reclaimed into the cleaning unit 15 by the cleaning blade 15*a*.

Although not shown in the drawings, the toner supplying unit arranged in the apparatus body 1 includes bottle-shaped toner containers 28 of replaceable configuration and a toner hopper unit that holds and rotationally drives the toner containers 28 and supplies new toners to the developing units 13. Each toner container 28 contains new toner (any one of yellow, magenta, cyan, and black). Spiral protrusions are formed on the inner periphery of the toner container 28 (toner bottle).

The new toner in the toner container 28 is supplied into the developing unit 13 through a toner supply port when needed according to the consumption of the toner in the developing unit 13 (existing toner). Although not shown in the drawings, the consumption of the toner in the developing unit 13 is directly or indirectly detected by a reflection type photo sensor which is opposed to the photosensitive element 11 and a magnetic sensor which is arranged under the second conveying screw 13*b*2'of the developing unit 13.

Hereinafter, the configuration and operation of the lubricant supplying unit (a lubricant supplying device) 16 of the present embodiment will be described in detail.

As shown in FIGS. 2 and 3, the lubricant supplying unit 16 includes: the solid lubricant 16*b*; the brush-like rotating member 16*a* (brush-like roller) which is covered with bristles that make sliding contact with the photosensitive element 11 and the solid lubricant 16*b*; the compression spring 16*c* which biases the solid lubricant 16*b* toward the brush-like rotating member 16*a*; and the blade-like member 16*d* which makes the lubricant that is supplied onto the photosensitive element 11 by the brush-like rotating member 16*a* into a thin film.

The brush-like rotating member 16*a* has bristles of 0.2 to 20 mm (preferably 0.5 to 10 mm) in length (thickness), which are implanted in ground fabric and wound around a core in a spiral configuration.

Bristles beyond 20 mm in length may collapse in a certain direction when repeatedly slid against the photosensitive element 11 over time. This can lower the capability of scraping the solid lubricant 16*b* and removing toner from the photosensitive element 11. On the other hand, bristles below 0.2 mm in length lack physical contact force against the solid lubricant 16*b* and the photosensitive element 11. It is therefore preferred that the bristles have a length in the foregoing range.

The brush-like rotating member 16*a* rotates so as to make contact with the photosensitive element 11, which rotates clockwise in FIGS. 2 and 3, in a counter direction (rotates clockwise in FIGS. 2 and 3). The brush-like rotating member 16*a* is arranged in sliding contact with the solid lubricant 16*b* and the photosensitive element 11. The rotation of the brush-like rotating member 16*a* scrapes some of the solid lubricant 16*b* and applies it onto the photosensitive element 11.

In order to avoid uneven contact between the brush-like rotating member 16*a* and the solid lubricant 16*b*, the compression spring 16*c* is arranged behind the solid lubricant 16*b*, biasing the solid lubricant 16*b* toward the brush-like rotating member 16*a*.

In the present embodiment, the solid lubricant 16*b* is made primarily of zinc stearate. More specifically, the solid lubricant 16*b* is formed by dissolving a lubricant additive in zinc stearate as a main component. One having a sufficient lubrication property with no side effect from excessive use is suitable.

Zinc stearate is representative lamellar crystal powder. A lamellar crystal has a self-organized layer structure of amphipathic molecules. The crystal is likely to crack and slip between layers under shearing force. This can reduce the coefficient of friction on the surface of the photosensitive element 11. That is, the uniform coating of lamellar crystals on the surface of the photosensitive element 11 under shearing force makes it possible to cover the surface of the photosensitive element 11 with a small amount of lubricant efficiently.

Aside from zinc stearate, examples of the solid lubricant 16*b* include stearate group-containing substances such as barium stearate, ferric stearate, nickel stearate, cobalt stearate, copper stearate, strontium stearate, and calcium stearate. Fatty acid compounds other than stearates, such as zinc oleate, barium oleate, and lead oleate, and compounds similar to stearates, such as zinc palmitate, barium palmitate, and lead palmitate, may be used. Other fatty acid compounds such as caprylates, linolenates, and co-linolenic acid may also be used. Waxes such as candelilla wax, carnauba wax, rice wax, Japan wax, jojoba oil, beeswax, and lanolin may be used. Such substances are easy to make organic solid lubricants, and are well-suited to for toner.

When applied to the surface of the photosensitive element 11 via the brush-like rotating member 16*a*, the solid lubricant 16*b* resides on the surface of the photosensitive element 11 in a powder form. Since the lubricant in such a state will not provide a sufficient lubrication, the blade-like member 16*d* (thinning blade) functions to even out the lubricant. The blade-like member 16*d* makes the lubricant on the photosensitive element 11 into a film so that the lubricant fully exerts its lubricity.

The finer the lubricant powder applied by the brush-like rotating member 16*a* is, the thinner the molecular film into which the blade-like member 16*d* makes the lubricant on the photosensitive element 11 becomes.

Hereinafter, the characteristic configuration of the image forming apparatus 1 according to the present embodiment will be described in detail.

As previously described with reference to FIG. 1, the image forming apparatus 1 according to the present embodiment has the black image forming unit or monochrome process cartridge 10BK at the downstream end in the running direction of the intermediate transfer belt 17 with respect to the other image forming units or color process cartridges 10Y, 10M, and 10C. In addition, the monochrome process cartridge 10BK (black image forming unit) is configured so that its lubricant supplying unit 16 contains a larger amount of lubricant than in the color process cartridges 10Y, 10M, and 10C (other image forming units).

Specifically, referring to FIGS. 2 and 3, the monochrome process cartridge 10BK (black image forming unit) is configured so that the solid lubricant 16*b* in the lubricant supplying unit 16 has a size greater than that of the solid lubricants 16*b* in the lubricant supplying units 16 of the color process cartridges 10Y, 10M, and 10C (other image forming units).

Since the monochrome process cartridge 10BK includes the solid lubricant 16*b* of greater size, the total time of supply of the lubricant to the photosensitive element 11 can be made longer as compared to the color process cartridges 10Y, 10M, and 10C. This can postpone the degradation of the photosensitive element 11. As a result, it is possible to extend the life of the monochrome process cartridge 10BK whose use frequency is higher than those of the color process cartridges 10Y, 10M, and 10C.

Now, since the solid lubricant 16*b* is formed to be larger, the monochrome process cartridge 10BK has a vertical height H1 greater than the vertical height H2 of the color process cartridges 10Y, 10M, and 10C (H1>H2). Specifically, the lubricant supplying unit 16 of the monochrome process cartridge 10BK is protruded downward as much as the solid lubricant 16*b* is made larger.

However, in the image forming apparatus 1 according to the present embodiment, the monochrome process cartridge 10BK is arranged at the end of the plurality of process cartridges 10Y, 10M, 10C, and 10BK (at the downstream end). Such arrangement makes it possible to provide a large continuous space under the plurality of process cartridges 10Y, 10M, 10C, and 10BK. Specifically, referring to FIG. 1, the writing unit 6 in the present embodiment is arranged close to the plurality of process cartridges 10Y, 10M, 10C, and 10BK so as not to interfere with the lubricant supplying unit 16 of the monochrome process cartridge 10BK.

Such a configuration eliminates the need to increase the vertical height of the image forming apparatus 1 even if the lubricant supplying unit 16 (solid lubricant 16*b*) is increased in size to extend the life of the monochrome process cartridge 10BK.

Referring to FIGS. 2 and 3, in the present embodiment, the monochrome process cartridge 10BK (black image forming unit) is configured so that the brush-like rotating member 16*a* has an outer diameter larger than in the color process cartridges 10Y, 10M, and 10C (other image forming units). Specifically, the bristles on the brush-like rotating member 16*a* of the monochrome process cartridge 10BK and those on the brush-like rotating members 16*a* of the color process cartridges 10Y, 10M, and 10C both have a length of 0.2 to 20 mm, and are arranged around cores of different outer diameters.

Configuring the brush-like rotating member 16*a* (core) with a larger outer diameter reduces the possibility of the brush-like rotating member 16*a* being deformed to cause uneven application (variations) of the lubricant to the photosensitive element 11.

Since the brush-like rotating member 16*a* is configured to have a larger outer diameter, the monochrome process cartridge 10BK has a vertical height H1 greater than the vertical height H2 of the color process cartridges 10Y, 10M, and 10C (H1>H2). However, in the image forming apparatus 1 according to the present embodiment, the monochrome process cartridge 10BK is arranged at the end of the plurality of process cartridges 10Y, 10M, 10C, and 10BK (at the downstream end). Such arrangement eliminates the need to increase the vertical height of the entire image forming apparatus 1.

Referring to FIGS. 2 and 3, in the present embodiment, the monochrome process cartridge 10BK (black image forming unit) is configured so that the blade-like member 16*d* has a contact angle (the angle formed between the blade-like member 16*d* and the segment that connects the center of the photosensitive element 11 and the position at which the photosensitive element 11 makes contact with the blade-like member 16*d*) greater than in the color process cartridges 10Y, 10M, and 10C (other image forming units).

Specifically, the blade-like members 16*d* of the color process cartridges 10Y, 10M, and 10C have a contact angle θ2 of approximately 90°. The blade-like member 16*d* of the monochrome process cartridge 10BK has a contact angle θ1 in the range of 91° to 160°.

Since the blade-like member 16*d* of the monochrome process cartridge 10BK is set to an obtuse contact angle θ1, the blade-like member 16*d* has a smaller frictional resistance with respect to the photosensitive element 11. This postpones the wearing degradation of the blade-like member 16*d* and the photosensitive element 11 due to sliding contact between the two members 16*d* and 11, and reduces the driving torque of the photosensitive element 11.

Since the blade-like member 16*d* has an obtuse contact angle, the monochrome process cartridge 10BK becomes greater than the color process cartridges 10Y, 10M, and 10C in vertical height. However, in the image forming apparatus 1 according to the present embodiment, the monochrome process cartridge 10BK is arranged at the end of the plurality of process cartridges 10Y, 10M, 10C, and 10BK (at the downstream end). Such arrangement eliminates the need to increase the vertical height of the entire image forming apparatus 1.

Now, in the present embodiment, the monochrome process cartridge 10BK (black image forming unit) may use a solid lubricant 16*b* of different type from those of the color process cartridges 10Y, 10M, and 10C (other image forming units). Specifically, the color process cartridges 10Y, 10M, and 10C may use a solid lubricant 16*b* that is made of zinc stearate. The monochrome process cartridge 10BK (black image forming unit) may use a solid lubricant 16*b* that is made of a mixture of zinc stearate and at least boron nitride.

As described previously, the solid lubricant 16*b* made of zinc stearate can provide a sufficient lubrication on the surface of the photosensitive element 11. The solid lubricant 16*b* made of a mixture of zinc stearate and boron nitride can provide an even higher lubrication on the surface of the photosensitive element 11. This can further extend the life of the photosensitive element 11 in the monochrome process cartridge 10BK.

Referring to FIGS. 2 and 3, in the present embodiment, the monochrome process cartridge 10BK (black image forming unit) is configured so that the gap between the roller charging device 12*a* and the photosensitive element 11 is smaller than in the color process cartridges 10Y, 10M, and 10C (other image forming units).

Specifically, the gap δ1 between the roller charging device 12*a* and the photosensitive element 11 in the monochrome process cartridge 10BK is set to be smaller than the gap δ2 between the roller charging device 12*a* and the photosensitive element 11 in the color process cartridges 10Y, 10M, and 10C.

Since the monochrome process cartridge 10BK is configured so that the roller charging device 12*a* and the photosensitive element 11 have a relatively small gap δ1 therebetween, it is possible to reduce the amount of ozone occurring during the discharge of the roller charging device 12*a*. The small setting of the gap δ1 between the roller charging device 12*a* and the photosensitive element 11 also makes it possible to reduce the vertical height of the monochrome process cartridge 10BK.

As has been described above, according to the present embodiment, the monochrome process cartridge 10BK (black image forming unit) is arranged at the downstream end in the running direction of the intermediate transfer belt 17.

The monochrome process cartridge 10BK is also configured so that its lubricant supplying unit 16 contains a larger amount of lubricant. Such an arrangement and configuration can extend the life of the monochrome process cartridge 10BK whose use frequency is higher than those of the color process cartridges 10Y, 10M, and 10C (other color image forming units) without upsizing the image forming apparatus 1.

In the present embodiment, the components of the image forming units (photosensitive elements 11, charging units 12, developing units 13, cleaning units 15, and lubricant supplying units 16) are integrated into the process cartridges 10Y, 10M, 10C, and 10BK for the sake of compact configuration and improved maintainability of the image forming units.

It should be noted that the components 11, 12, 13, 15, and 16 of the image forming units need not necessarily constitute process cartridges, and may be each mounted on the apparatus body 1 so as to be replaceable by itself. Even in such a case, the same effects as those of the present embodiment can be provided.

The present embodiment has dealt with the case where the present invention is applied to an image forming apparatus that incorporates the developing units 13 of two-component developing method which use a two-component developer. The present invention may be applied to an image forming apparatus that incorporates developing units 13 of one-component developing method which use a one-component developer.

The present embodiment has also dealt with the case where the present invention is applied to a color image forming apparatus of tandem type that uses the intermediate transfer belt 17. Nevertheless, the present invention may also be applied to a color image forming apparatus of tandem type that uses a transfer carriage belt (an apparatus in which a plurality of photosensitive elements are arranged in parallel so as to be opposed to the transfer carriage belt, and toner images on the photosensitive elements are transferred to a recording medium conveyed by the transfer carriage belt in a superposed manner). Even in such a case, the same effects as those of the present embodiment can be obtained by configuring the plurality of image forming units as in the present embodiment.

The present embodiment has also dealt with the case where the monochrome process cartridge 10BK (black image forming unit) is arranged at the downstream end in the running direction of the intermediate transfer belt 17 with respect to the color process cartridges 10Y, 10M, and 10C (other color image forming units). However, the monochrome process cartridge 10BK may be arranged at the upstream end in the running direction of the intermediate transfer belt 17 with respect to the color process cartridges 10Y, 10M, and 10C. Even in such a case, the same effects as those of the present embodiment can be obtained by configuring the monochrome process cartridge 10BK so that its lubricant supplying unit 16 contains a larger amount of lubricant.

It will be understood that the present invention is not limited to the present embodiment, and appropriate modifications other than pointed out in the present embodiment may be made to the present embodiment within the scope of the technical concept of the present invention. The number, positions, shapes, and other aspects of the foregoing components are not limited to the present embodiment, either. The number, positions, shapes, and other aspects may be suitably selected when practicing the present invention.

According to the present invention, the black image forming unit is arranged at the downstream end or upstream end in the running direction of the intermediate transfer belt or transfer carriage belt, and is configured so that its lubricant supplying unit contains a larger amount of lubricant. This makes it possible to provide an image forming apparatus in which the black image forming unit whose use frequency is higher than those of the other color image forming units has an extended life, without upsizing the apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising a plurality of image forming units that are arranged in parallel so as to be opposed to an intermediate transfer belt or a transfer carriage belt, the plurality of image forming units each including:

an image carrier that is opposed to the intermediate transfer belt or the transfer carriage belt and on a surface of which a toner image is to be formed; and a lubricant supplying unit that supplies a lubricant onto the image carrier, a black image forming unit that forms a black toner image among the plurality of image forming units being arranged at a downstream end or upstream end in a running direction of the intermediate transfer belt or the transfer carriage belt, and being configured so that the lubricant supplying unit contains a larger amount of lubricant with respect to other image forming units among the plurality of image forming units.

2. The image forming apparatus according to claim 1, wherein:

the lubricant supplying unit includes a brush-like rotating member around which bristles that makes sliding contact with the image carrier are arranged, and a solid lubricant that is in sliding contact with the brush-like rotating member; and the black image forming unit is configured so that the solid lubricant has a size larger than in the other image forming units.

3. The image forming apparatus according to claim 2, wherein the black image forming unit is configured so that the brush-like rotating member has an outer diameter larger than in the other image forming units.

4. The image forming apparatus according to claim 2, wherein:

the lubricant supplying unit further includes a blade-like member that makes contact with the image carrier in a counter direction at a position downstream of the brush-like rotating member in a direction of rotation of the image carrier and makes the lubricant supplied onto the image carrier into a thin layer; and the black image forming unit is formed so that an angle formed between the blade-like member and a segment that connects a center of the image carrier and the position at which the image carrier makes contact with the blade-like member is greater than in the other image forming units.

5. The image forming apparatus according to claim 2, wherein:

the solid lubricant in the black image forming unit is made of a mixture of zinc stearate and at least boron nitride; and the solid lubricants in the other image forming units are made of zinc stearate.

6. The image forming apparatus according to claim 1, wherein:

the plurality of image forming units each include a roller charging device that is opposed to the image carrier without contact and is arranged downstream of the lubricant supplying unit in a direction of rotation of the image carrier; and the black image forming unit is configured so that a gap between the roller charging device and the image carrier is smaller than in the other image forming units.

7. The image forming apparatus according to claim 1, comprising a writing unit that irradiates the surfaces of the image carriers of the plurality of image forming units with respective light beams to form latent images, the writing unit being arranged close to the plurality of image forming units so as not to interfere with the lubricant supplying unit of the black image forming unit.

8. The image forming apparatus according to claim 1, wherein the plurality of image forming units each include a cleaning unit that cleans the surface of the image carrier, the cleaning unit being arranged upstream of the lubricant supplying unit in the direction of rotation of the image carrier.

9. The image forming apparatus according to claim 1, wherein the plurality of image forming units are respective process cartridges to be detachably mounted on a body of the image forming apparatus.

* * * * *